US007001224B2

(12) United States Patent
Sakurai et al.

(10) Patent No.: US 7,001,224 B2
(45) Date of Patent: Feb. 21, 2006

(54) CONNECTOR WITH RETAINER FOR LOCKING TERMINAL FITINGS

(75) Inventors: Toshikazu Sakurai, Yokkaichi (JP); Yukihiro Fukatsu, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/810,776

(22) Filed: Mar. 26, 2004

(65) Prior Publication Data

US 2004/0192118 A1 Sep. 30, 2004

(30) Foreign Application Priority Data

Mar. 31, 2003 (JP) ..... 2003-094129

(51) Int. Cl.
*H01R 13/514* (2006.01)

(52) U.S. Cl. ..... 439/752; 439/595

(58) Field of Classification Search ..... 439/752, 439/595, 733, 347

See application file for complete search history.

(56) References Cited

U.S. PATENT DOCUMENTS 5,061,210 A * 10/1991 Jinno ..... 439/752
5,464,356 A * 11/1995 Nebeshima et al. ..... 439/752
5,865,653 A 2/1999 Okada et al. ..... 439/752
6,497,591 B1 * 12/2002 Fujita ..... 439/752
6,599,154 B1 * 7/2003 Sakurai et al. ..... 439/752

* cited by examiner

*Primary Examiner*—Alexander Gilman
(74) *Attorney, Agent, or Firm*—Gerald E. Hespos; Anthony J. Casella

(57) ABSTRACT

A connector has a housing (20) and a retainer (40) for locking terminal fittings in the housing (20). The retainer (40) has a main body (41) with locking sections (45) engageable with the terminal fittings when the retainer (40) is at a full locking position in the housing (20). Side plates (42) are provided at opposite lateral sides of the main body (41) for covering stepped outer side surfaces (29) of the housing (20). A locking claw (53) is provided at an upper end (42*a*) of each side plate (42) for engaging a holding portion (33) on the stepped surface (29). The retainer (40) can be held at the full locking position by engagement of the locking claws (53) and the holding portions (33). The housing (20) has protecting portions (35) that cover the upper ends (42*a*) of the side plates (42) from outer sides when the retainer (40) is at the full locking position.

11 Claims, 13 Drawing Sheets

CONNECTOR WITH RETAINER FOR LOCKING TERMINAL FITINGS

BACKGROUND OF THE INVENTION

1. Field of the Invention

The present invention relates to a connector provided with a retainer.

2. Description of the Related Art

U.S. Pat. No. 5,865,653 discloses a connector that has a housing formed with cavities for receiving terminal fittings. A retainer mount hole is formed in an outer surface of the housing and communicates with the cavities. The connector also has a retainer with a main body. Side plates project from opposite lateral ends of the main body and locking sections project from positions on the main body between the side plates. The retainer can be mounted to the housing so that the main body enters the mount hole and so that the side plates hold the outer side surfaces of the housing from opposite sides. The retainer is mounted for movement between a partial locking position and a full locking position. The locking sections of the main body are retracted from cavities when the retainer is at the partial locking position to permit insertion and withdrawal of terminal fittings. However, the locking sections enter the cavities to engage the terminal fittings when the retainer is moved to the full locking position. A locking recess is formed in the inner surface of each side plate of the retainer for engaging corresponding partial and full locking projections on the outer side surfaces of the housing. Thus, the retainer can be held selectively at the partial locking position or the full locking position.

The side plates of the above-described retainer are exposed constantly to the outside since the housing is held between them. Thus, there is a possibility that external matter could strike against or catch the leading end of the side plate while the retainer is at the full locking position. Such contact could deform the side plate away from the side surface of the housing to disengage the locking recess from the full locking projection. Consequently the retainer could be displaced toward the partial locking position.

The invention was developed in view of the above problem and an object thereof is to reliably position a retainer at a proper mount position.

SUMMARY OF THE INVENTION

The invention relates to a connector with a housing for receiving one or more terminal fittings. The connector also has a retainer that can be mounted to the housing for locking the terminal fittings in the housing. The retainer comprises a main body with one or more locking sections for locking the terminal fittings when the retainer is mounted at a proper mount position with respect to the housing. Side plates are provided at opposite lateral ends of the retainer main body for at least partly covering outer surfaces of the connector housing. The housing includes protections for covering peripheral ends of the side plates from outer sides when the retainer is mounted at the proper mount position. The protecting portions substantially prevent external matter from interfering with the peripheral ends of the side plates. Thus, the side plates are not likely to be deformed by external matter and the retainer is less likely to be displaced from the proper position.

Holding means preferably are provided on the side plates and/or the outer surfaces of the housing to hold the retainer at the proper mount position.

The holding means may comprise holding portions on the outer surfaces of the housing and locks on the inner surfaces of the side plates for engaging the holding portions. The side plates preferably are resiliently deformable away from the corresponding outer surfaces of the housing as the locks move onto the holding portions during the mounting and/or detaching of the retainer. Escaping surfaces may be provided on at least one of the facing surfaces of the protecting portions and the side plates for letting the side plates resiliently deform away from the corresponding outer surfaces of the housing. Thus, the retainer can be mounted and detached smoothly.

The escaping surfaces preferably are provided on both the facing surfaces of the protecting portions and those of the side plates. Additionally, the protecting portions preferably are substantially flush with the side plates at their outer ends. Accordingly, the connector can be miniaturized.

The escaping surfaces of the protecting portions preferably are set to have a more moderate inclination than the escaping surfaces of the side plates.

A specified clearance preferably is defined between the retainer and a portion of the housing when the retainer is at a position different from the proper mount position. Thus, the inserted states of the male terminal fittings can be confirmed through this clearance from outside the housing.

Weakened portions preferably are provided in the side plates to make the side plates easier to deform away from outer surfaces of the housing.

Locking means preferably are provided for holding the retainer at a position on or in the housing different from the proper mount position.

Guiding means preferably are provided on the side plates and/or the outer surfaces of the housing for guiding the movement the retainer with respect to the housing.

These and other objects, features and advantages of the present invention will become more apparent upon reading of the following detailed description of preferred embodiments and accompanying drawings. It should be understood that even though embodiments are separately described, single features thereof may be combined to form additional embodiments.

DETAILED DESCRIPTION OF THE PREFERRED EMBODIMENTS

A connector according to the invention includes a male housing 20, male terminal fittings 10 to be accommodated in the male housing 20, and a retainer 40 mountable into the male housing 20 in a mounting direction MD, as shown in FIGS. 1 to 13. In the following description, inserting and withdrawing directions IWD of the male terminal fittings 10 into the male housing 20 are referred to as forward and backward directions, respectively, and reference is made to all the figures except FIG. 3 concerning the vertical direction.

Figure 7:
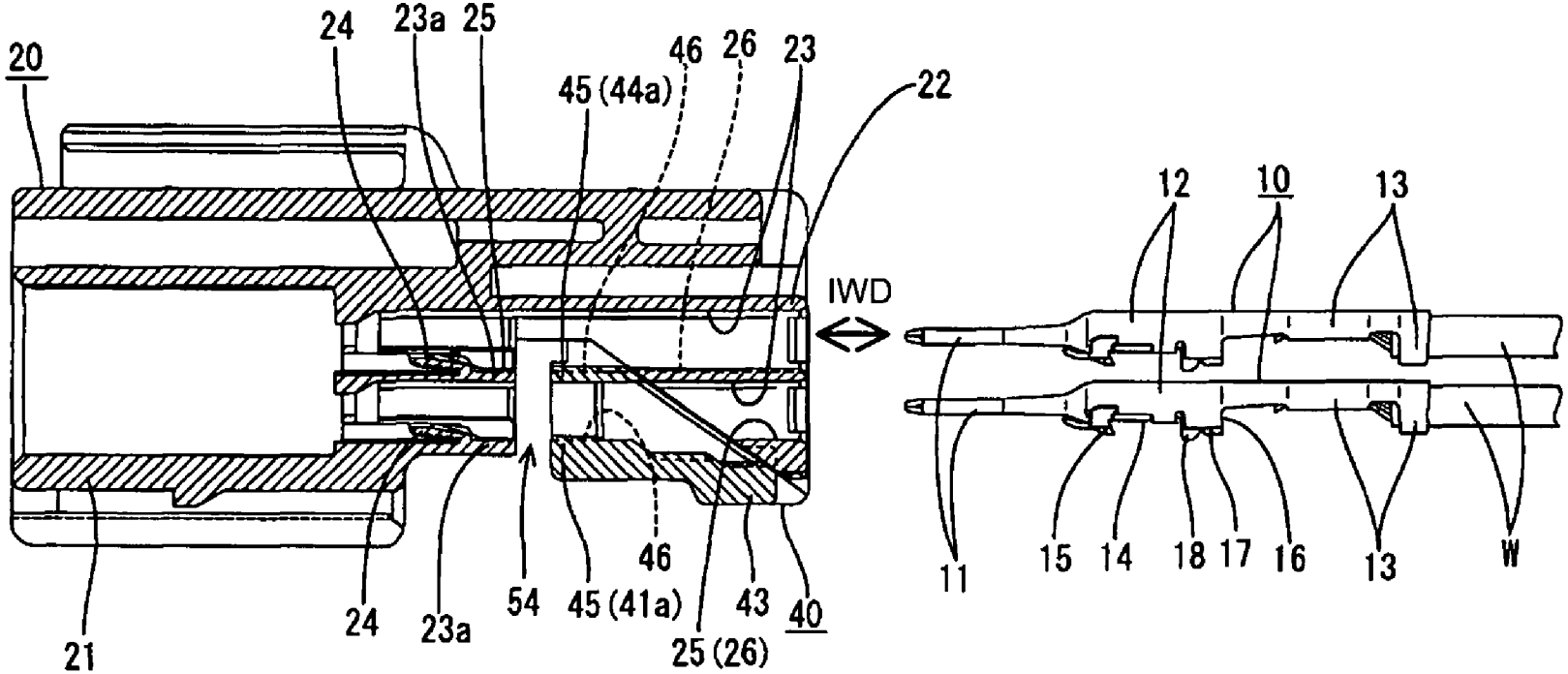
FIG. 7 is a side view in section showing male terminal fittings and the male housing in which the retainer is mounted at a partial locking position.
Figure 8:
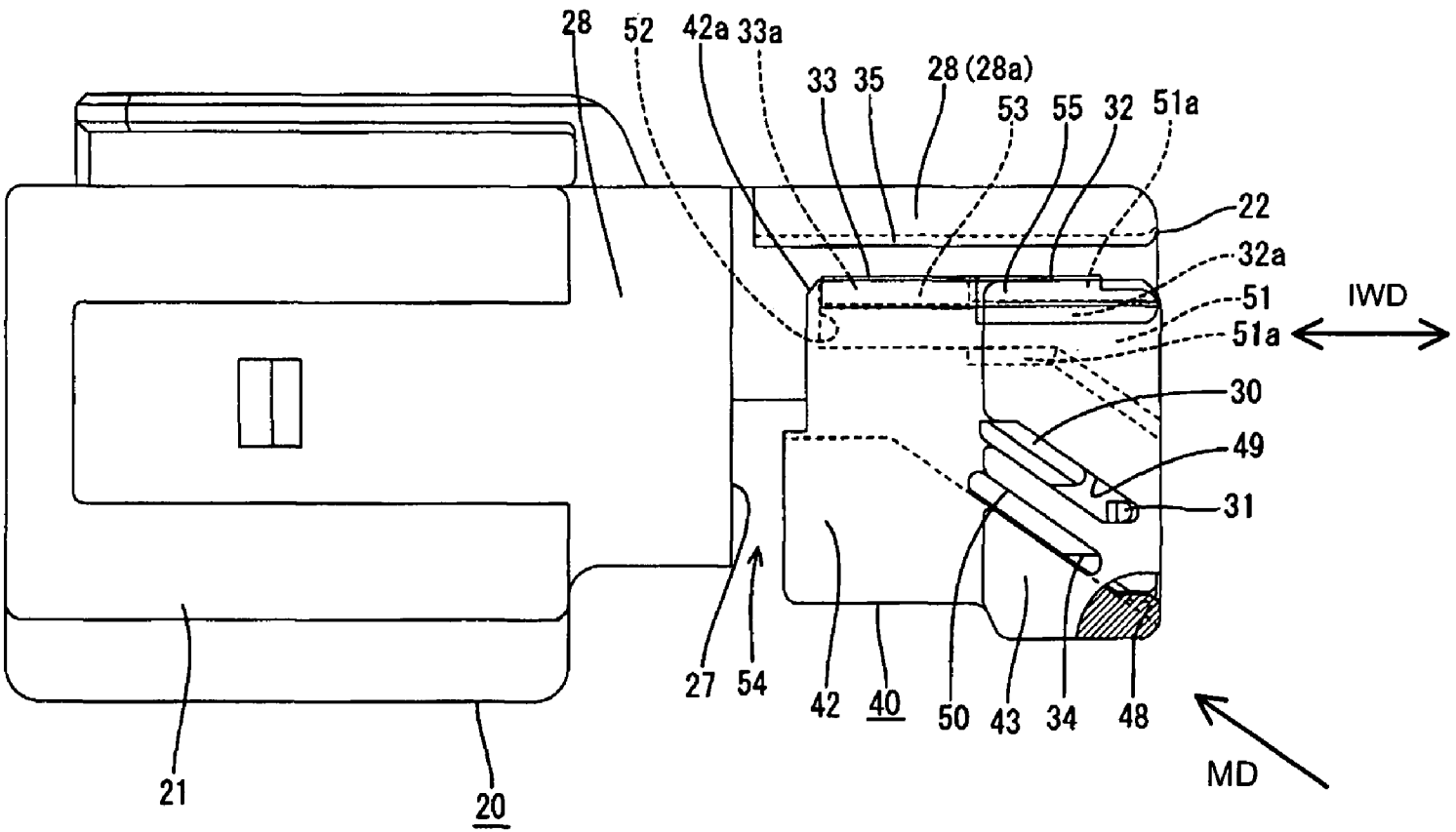
FIG. 8 is a side view partly in section of the male housing in which the retainer is mounted at the partial locking position.
Figure 9:
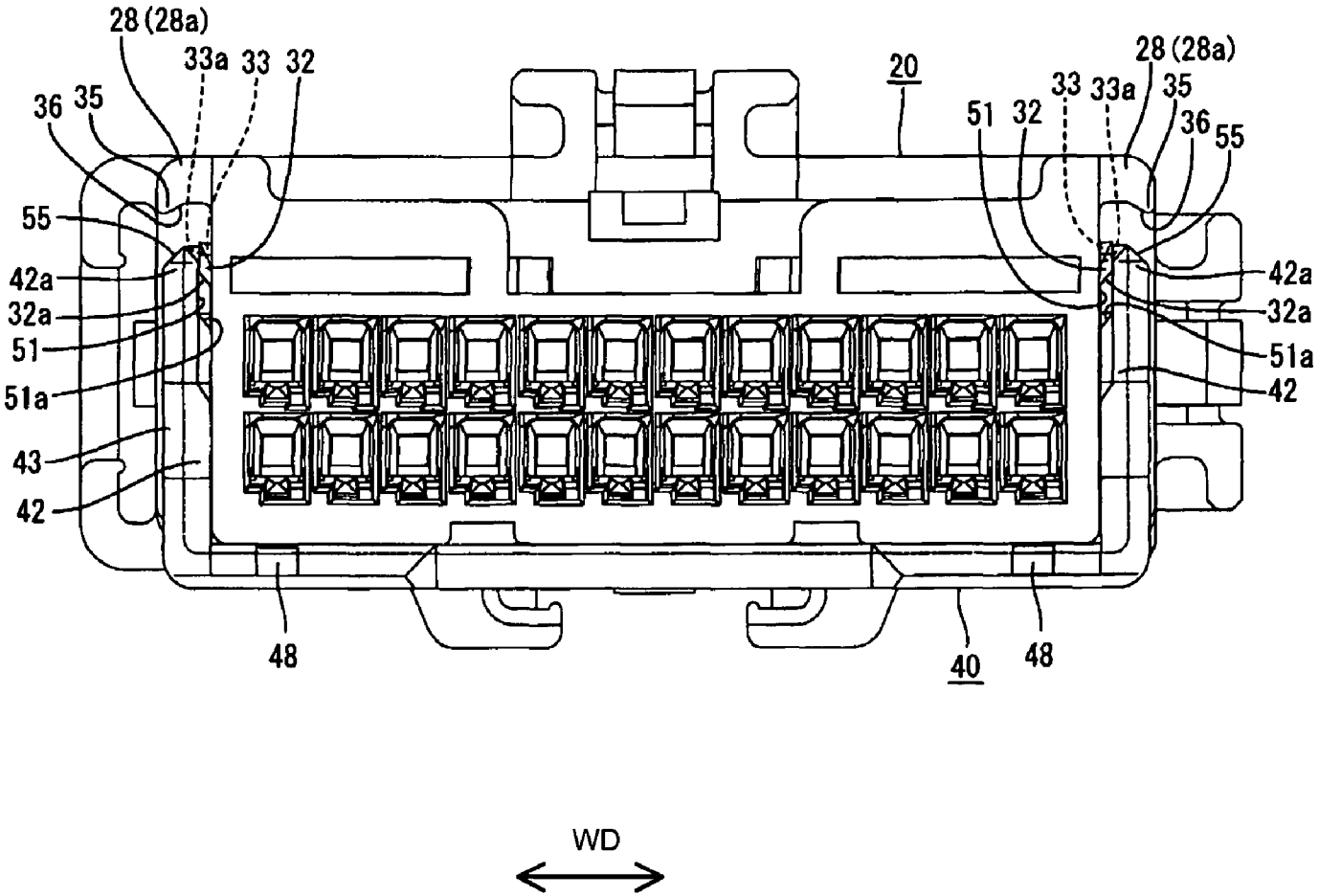
FIG. 9 is a rear view of the male housing in which the retainer is mounted at the partial locking position.
Figure 10:
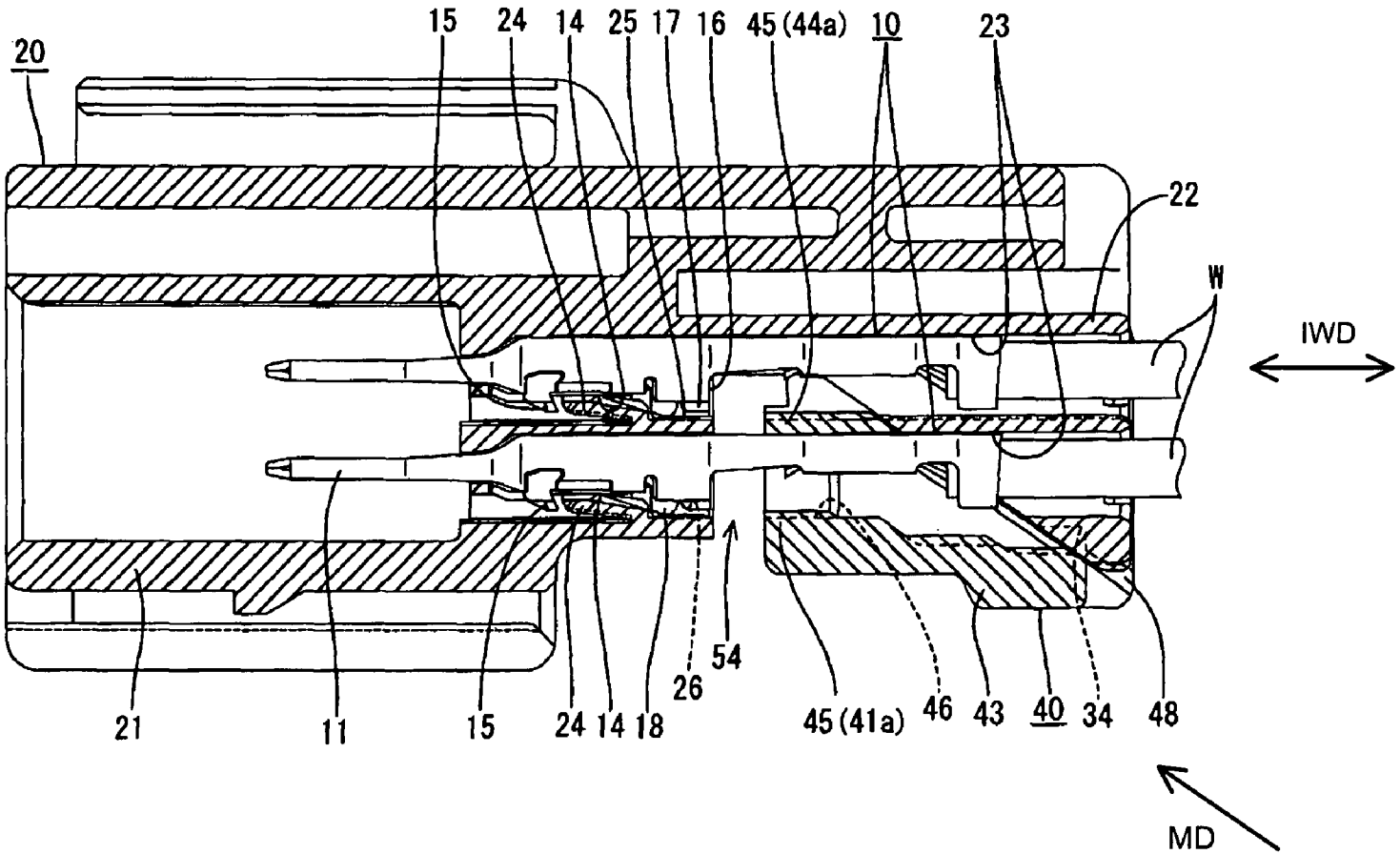
FIG. 10 is a side view is section showing a state where the male terminal fittings are inserted.

The male terminal fitting 10 is formed by applying bending, folding, embossing and/or other processing to a conductive metallic plate stamped or cut out to have a specified shape. The male terminal fitting 10 includes a tab 11, a substantially box-shaped main portion 12 and a barrel 13 in this order from the front side, as shown in FIG. 7. The tab 11 is electrically connectable with a mating female terminal fitting (not shown) and the barrel 13 can be crimped into connection with an end of a wire W. The tab 11 is formed from a plate piece that is narrow and long in forward and backward directions and that extends from the front edge of the main portion 12. The plate piece is bent at a longitudinal middle position so that upper and lower parts are held substantially in close contact. The barrel 13 has front crimping pieces that are crimped into connection with a core of the wire W and rear crimping pieces that are crimped into connection with an insulation coating of the wire W.

A recess 14 is formed substantially in the longitudinal middle of the bottom surface of the main portion 12. The front edge of the recess 14 is embossed to project down and out to form a locking projection 15 and a locking step 16 is formed at the rear end of the bottom surface of the main portion 12. A protrusion 17 is embossed at the locking step 16 and projects to substantially the same height as the locking projection 15. A stabilizer 18 is formed at a position immediately before the protrusion 17 and projects more down and out than the protrusion 17. The stabilizer 18 stabilizes the insertion of the male terminal fitting 10 and prevents an upside-down insertion.

The male housing 20 is made e.g. of a synthetic resin and has a receptacle 21 and a terminal accommodating portion 22 disposed one after the other. The receptacle 21 is a substantially rectangular tube that opens forward for receiving a mating female connector from the front. A lock (not shown) is provided on the ceiling of the receptacle 21 and is engageable by a lock arm of the female housing to hold the female connector in the receptacle 21.

Figure 2:
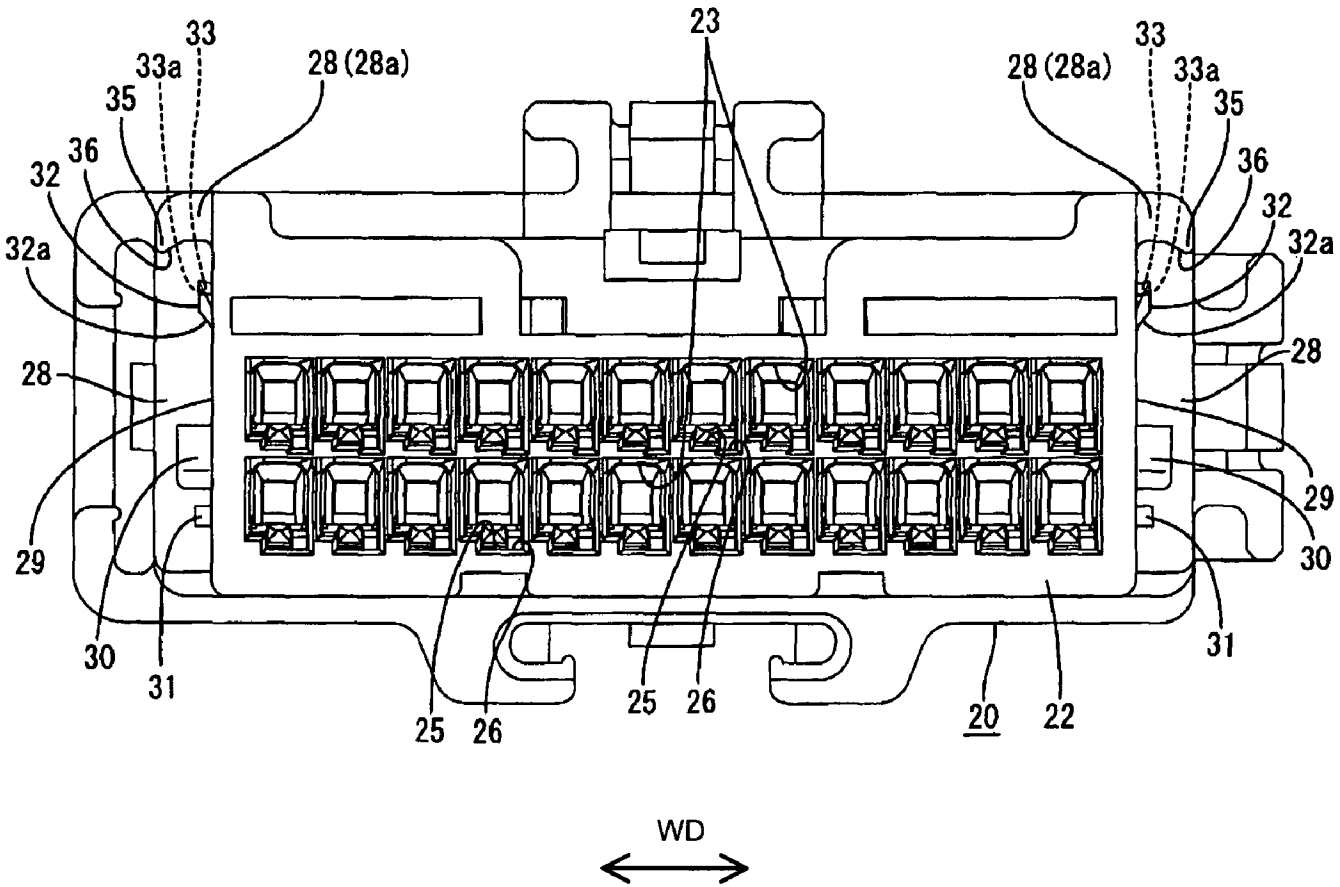
FIG. 2 is a rear view of the male housing.
Figure 3:
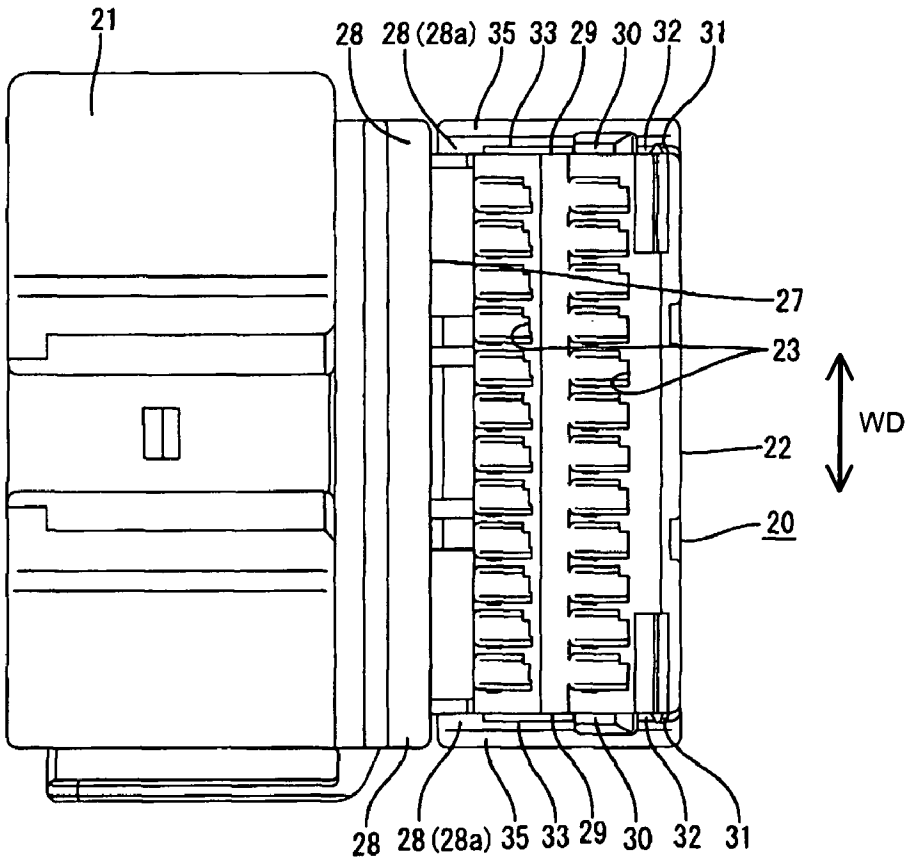
FIG. 3 is a bottom view of the male housing.

As shown in FIGS. 2 and 7, the terminal accommodating portion 22 is substantially a block that is wide in a widthwise direction WD and is provided internally with cavities 23 for receiving the male terminal fittings 10 from behind. The cavities 23 penetrate the male housing 20 substantially in forward and backward directions, and a plurality of cavities are arranged in the widthwise direction WD at upper and lower stages. A resiliently deformable lock 24 is provided at the bottom surface of each cavity 23 and is engageable with the male terminal fitting 10. The lock 24 cantilevers forward and is resiliently deformable up and down in directions intersecting the inserting and withdrawing directions IWD of the male terminal fittings 10. A protrusion insertion groove 25 is formed substantially in the widthwise middle of the bottom surface of the cavity 23 for receiving the lock 15 and the protrusion 17. The protrusion insertion groove 25 is formed over substantially the entire length of the lock 24 for reducing the degree of resilient deformation of the lock 24 during the insertion of the male terminal fitting 10. A stabilizer insertion groove 26 is formed at the left edge of FIG. 2 for receiving the stabilizer 18. The stabilizer insertion groove 26 reaches a position slightly behind the base end of the lock 24 and is open only backward. The stabilizer insertion grooves 26 are deeper than the protrusion insertion grooves 25 at the upper stage, whereas the depths of the grooves 26, 25 are substantially equal at the lower stage.

A retainer mount hole 27 is formed in outer surfaces of the terminal-accommodating portion 22 for receiving the retainer 40. The retainer mount hole 27 is open in the bottom surface of the male housing 20 facing a mounting direction MD of the retainer 40. The retainer mount hole 27 also is open in opposite side surfaces of the male housing 20 that extend substantially along the mounting direction MD of the retainer 40. Accordingly, the retainer mount hole 27 is open at three sides of the male housing 20. The retainer mount hole 27 exposes all of the cavities 23 to the outside and has a depth sufficient to cut off about half of the partition walls between the adjacent cavities 23 at the upper stage. The retainer mount hole 27 also divides the bottom walls 23*a* of the upper and lower cavities 23 and the side walls of the cavities 23 at the lower stage into front and rear parts. The front edge of the retainer mount hole 27 is substantially straight along the vertical direction, which is a direction substantially normal to the insertion and withdrawal directions IWD. However, the rear edge of the retainer mount hole 27 is sloped down toward the back with respect to the insertion and withdrawal directions IWD. An angle of inclination of the rear edge with respect to the insertion and withdrawal directions IWD preferably is smaller than about 45°, and most preferably is about 35°, with respect to the inserting direction of the male terminal fittings 10. The retainer 40 is movable in the mounting direction MD substantially along the inclination of the rear edge of the retainer mount hole 27. Thus, the mounting direction MD is inclined to the insertion and withdrawal directions IWD by an angle preferably smaller than about 45°, most preferably about 35°.

Figure 1:
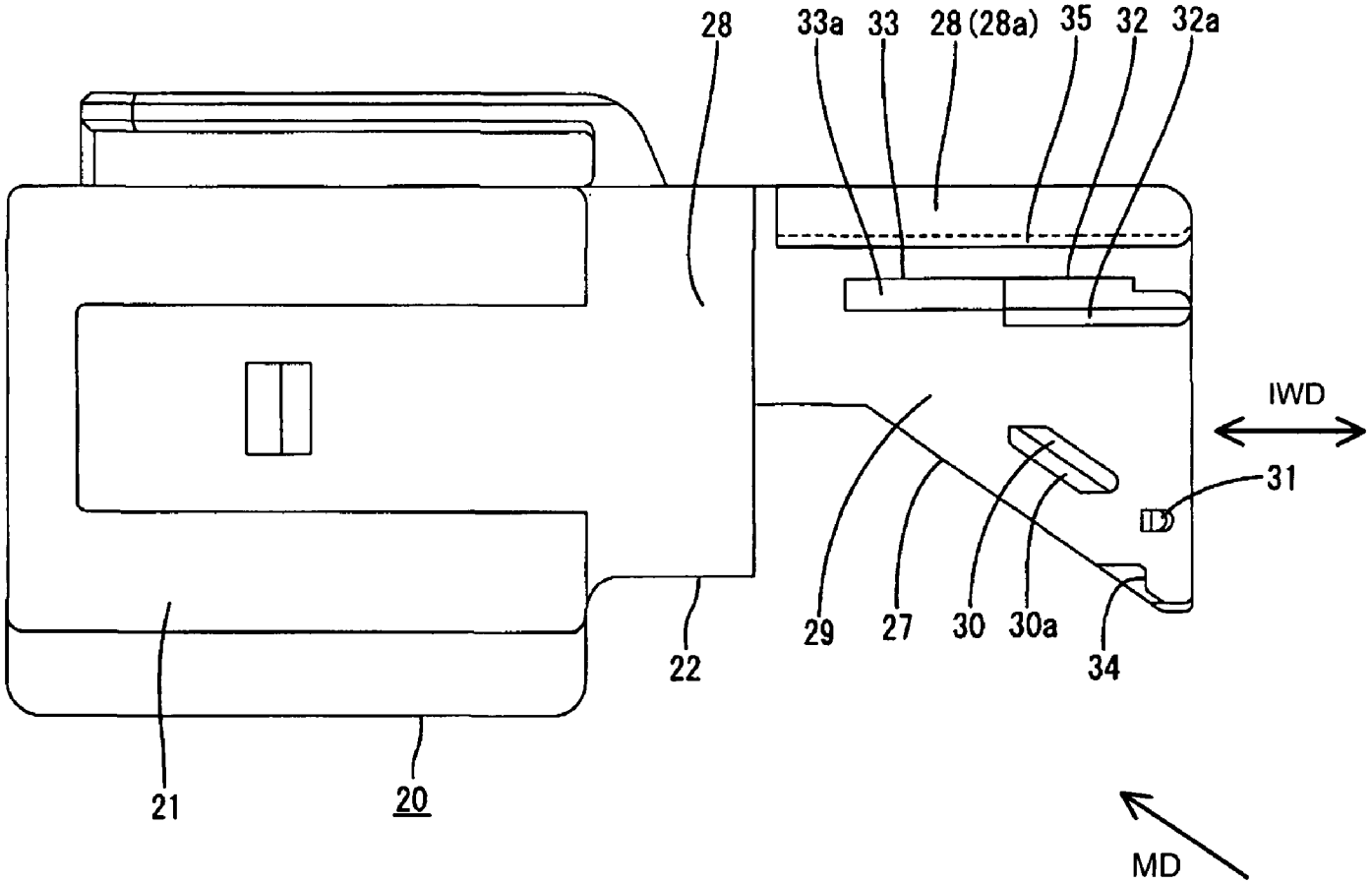
FIG. 1 is a side view of a male housing according to one embodiment of the invention.
Figure 6:
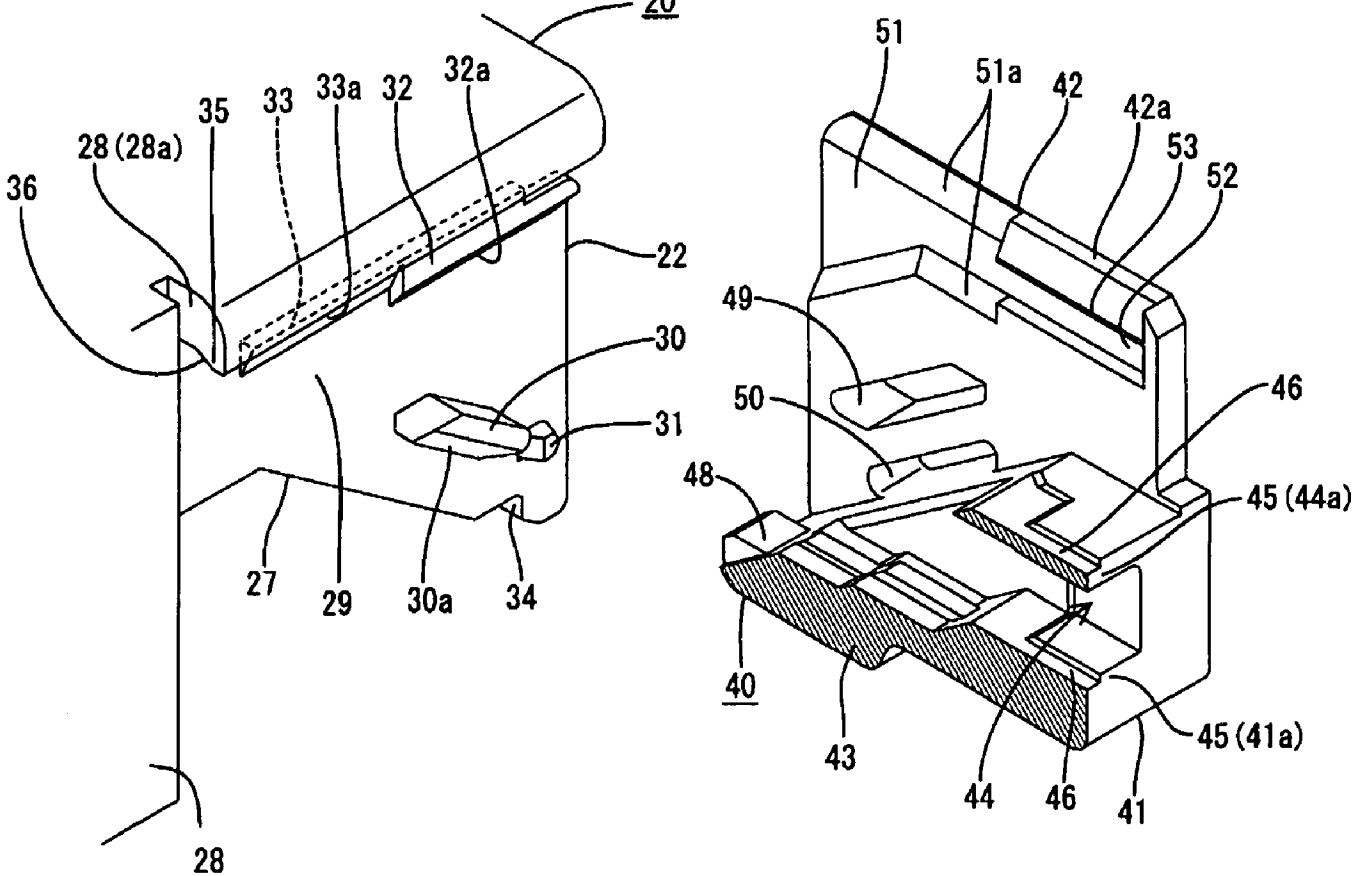
FIG. 6 is a perspective view showing portions of the male housing and the retainer around a locking projection and a guiding groove.

Each of the opposite outer side surfaces of the terminal accommodating portion 22 is recessed slightly in a specified area above and behind a side opening of the retainer mount hole 27, as shown in FIGS. 1 and 6, thereby forming a stepped surface 29 substantially where a corresponding side plate 42 of the retainer 40 is mountable. Thick portions 28 are defined on areas of the opposite outer side surfaces of the terminal-accommodating portion 22 where the stepped surfaces 29 are not formed. Thus, the thick portions 28 are at the upper ends of the terminal-accommodating portion 22 and at portions of the terminal-accommodating portion 22 before the retainer mount hole 27. The thick portions 28 project slightly out beyond the side plates 42, but are substantially flush with the side plates 42 at their outer ends when the retainer 40 is mounted. A rib-shaped locking projection 30 is provided on each stepped surface 29 and extends substantially along the inclination of the rear edge of the retainer mount hole 27. The locking projections 30 stabilize the posture of the retainer 40 being pushed in the mounting direction MD into the male housing 20. Each locking projection 30 has a beveled surface 30*a* that extends over substantially the entire area at the lower side of a longitudinal centerline, which is the side toward the retainer mount hole 27. Thus, the locking projection 30 can fit smoothly into a corresponding guiding groove 49 of the retainer 40. As shown in FIG. 6, the upper and lower end surfaces of each locking projection 30 are horizontal and extend substantially in the widthwise direction WD, and the upper end surface also is formed with a vertical surface continuous therewith.

A push-in preventing projection 31 is formed on an extension of the bottom end of the locking projection 30. The push-in preventing projection 31 is spaced from the locking projection 30 by a specified distance and engages the bottom end of the guiding groove 49 of the retainer 40 when the retainer 40 is at the partial locking position shown in FIGS. 7 to 10, thereby preventing the retainer 40 from being pushed inadvertently to a full locking position unless an operation force of a specified intensity or larger is exerted. Further, the push-in preventing projection 31 is engageable with the rear edge of the retainer 40 when the retainer 40 is moved to the full locking position.

Figure 11:
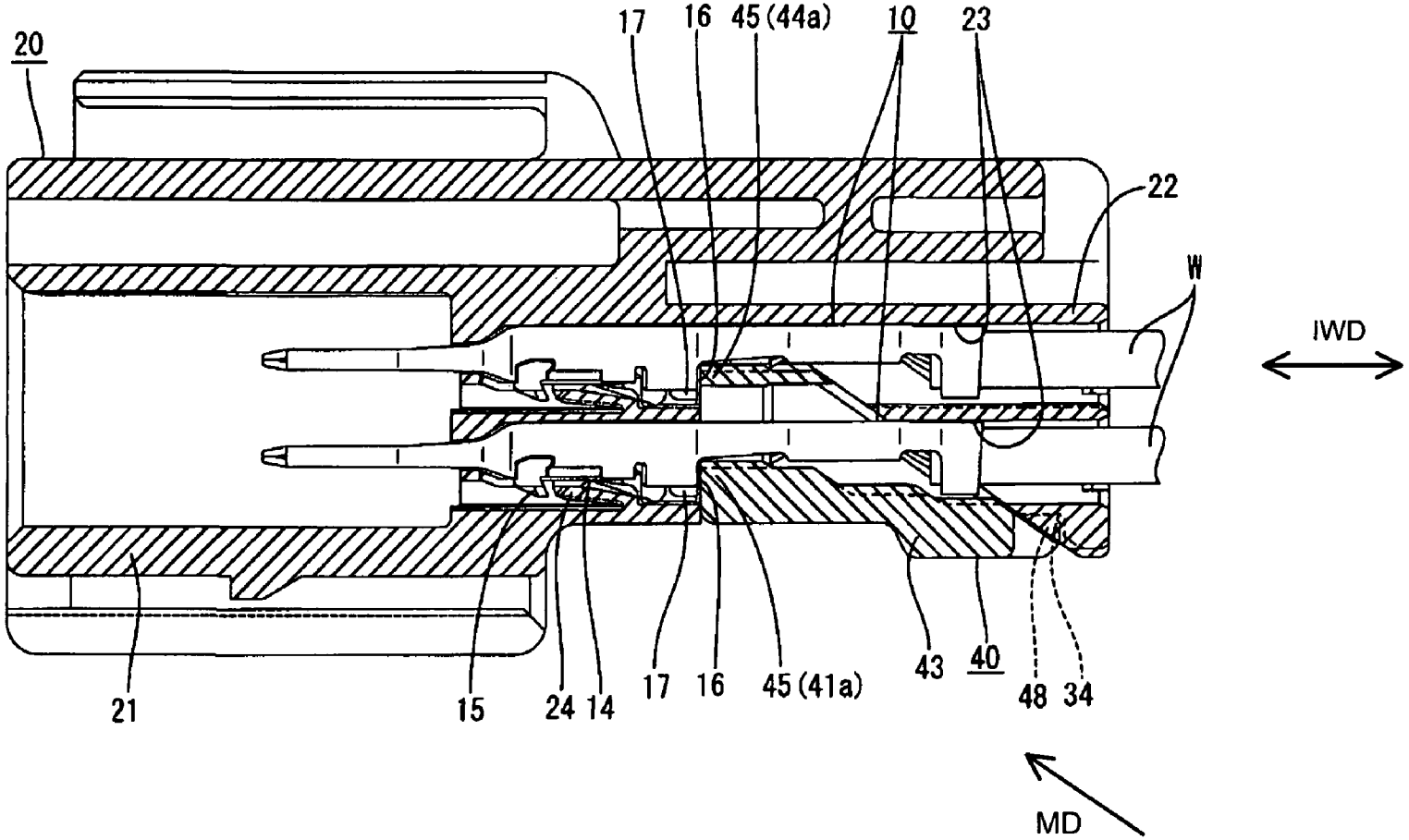
FIG. 11 is a side view in section showing a state where the retainer is mounted at a full locking position.
Figure 12:
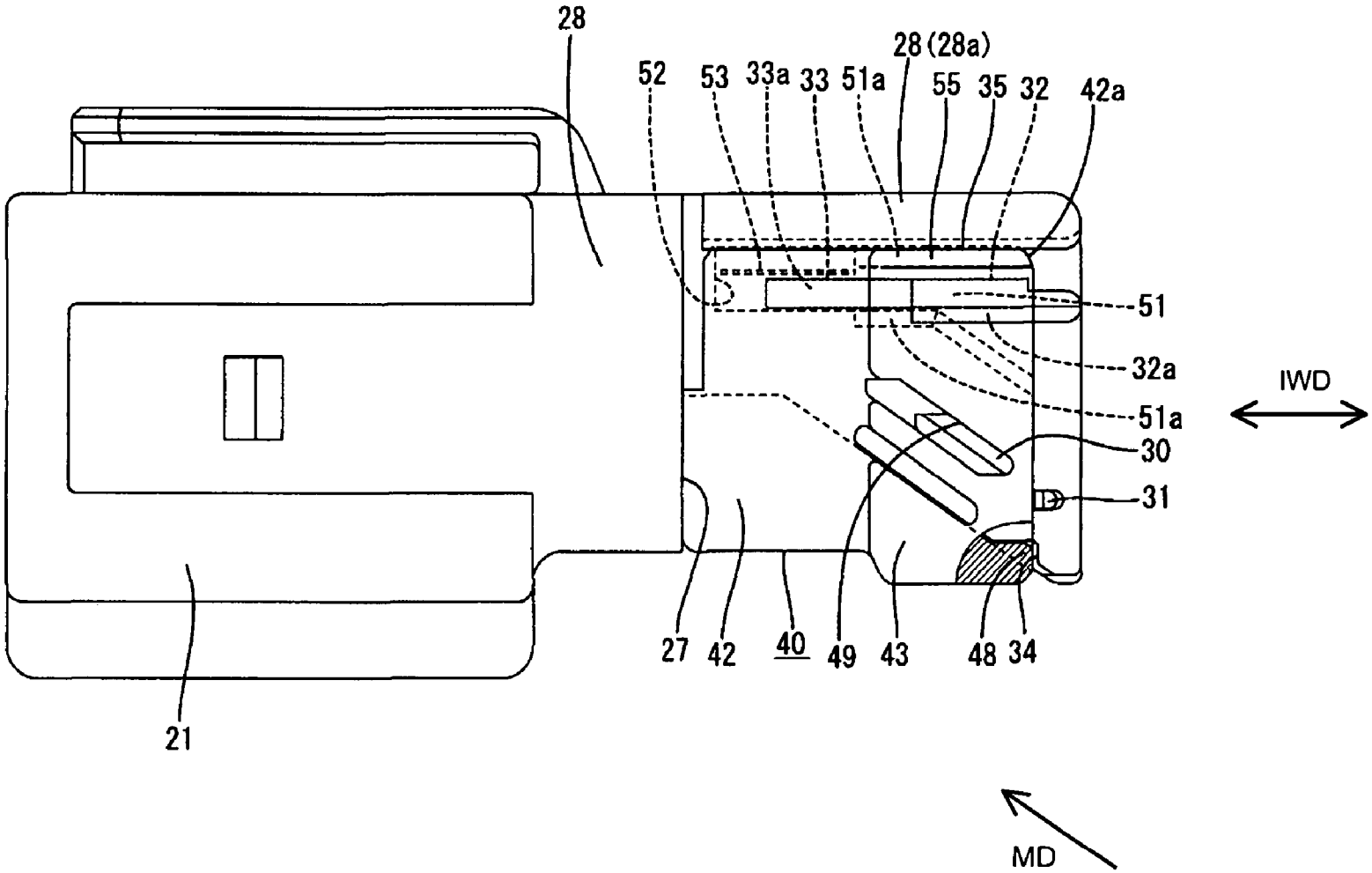
FIG. 12 is a side view partly in section showing the state where the retainer is mounted at the full locking position.
Figure 13:
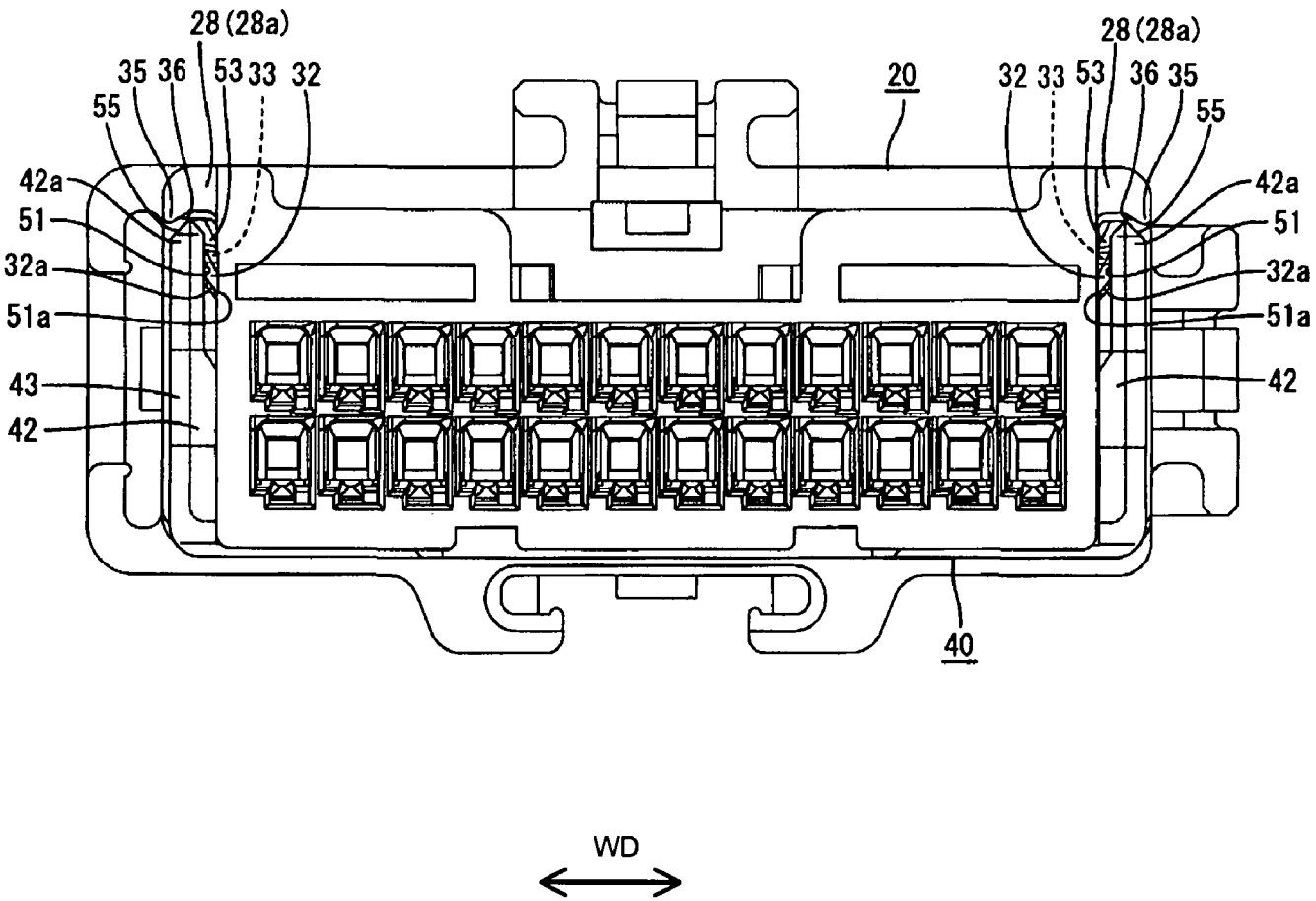
FIG. 13 is a rear view showing the state where the retainer is mounted at the full locking position.

A shake preventing portion 32 projects above the locking projection 30 on each stepped surface 29 for preventing the retainer 40 at the full locking position shown in FIGS. 11 to 13 from shaking. The shake-preventing portion 32 extends substantially horizontally along forward and backward directions and hence at an angle to the mounting direction MD. On the other hand, a slanted surface 32*a* is sloped up toward the outer side over substantially the entire length at the bottom side of the shake-preventing portion 32, which is the side towards the retainer mount hole 27. A holding portion 33 projects before the shake-preventing portion 32. The holding portion 33 has an upper end that is substantially continuous with the upper end of the shake-preventing portion 32. A slanted surface 33*a* slopes up toward the outer side at the bottom side of the holding portion 33. A locking recess 34 is provided at the bottom end of each widthwise end of a rear edge of the retainer mount hole 27. The rear surface of the receiving recess 34 extends substantially straight along a vertical direction and hence at an angle to the mounting direction MD.

Figure 4:
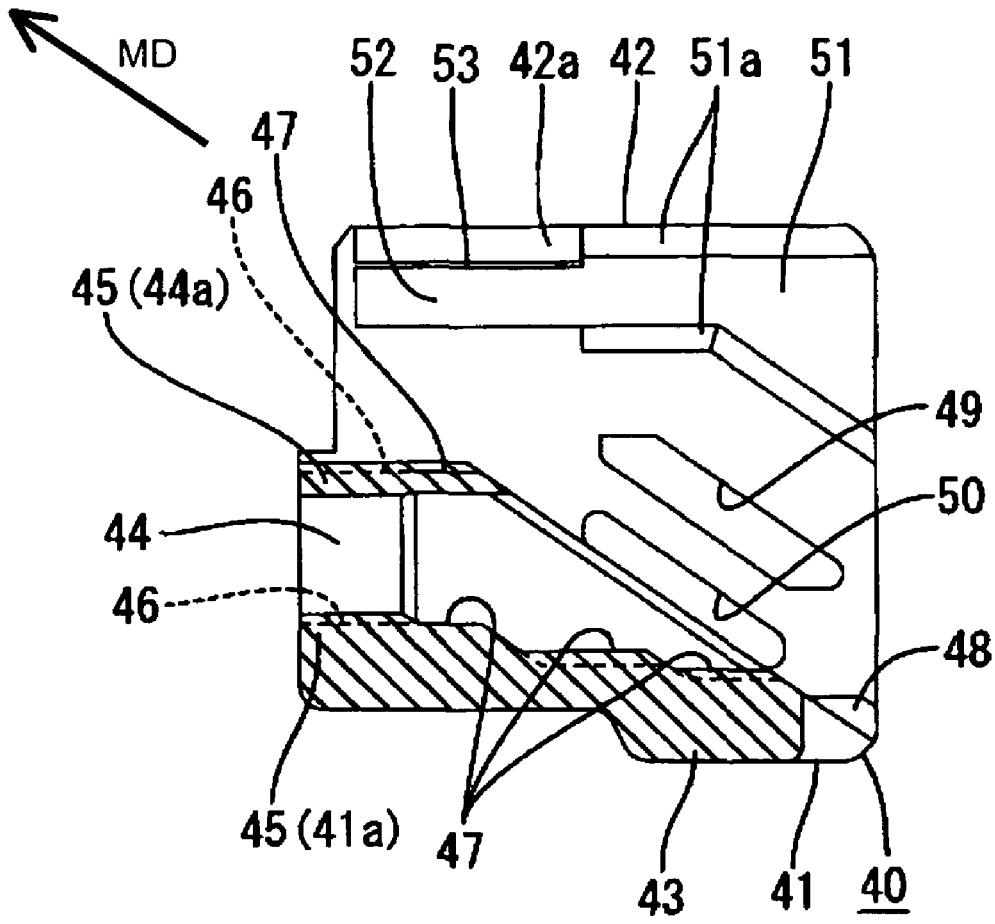
FIG. 4 is a side view in section of a retainer.
Figure 5:
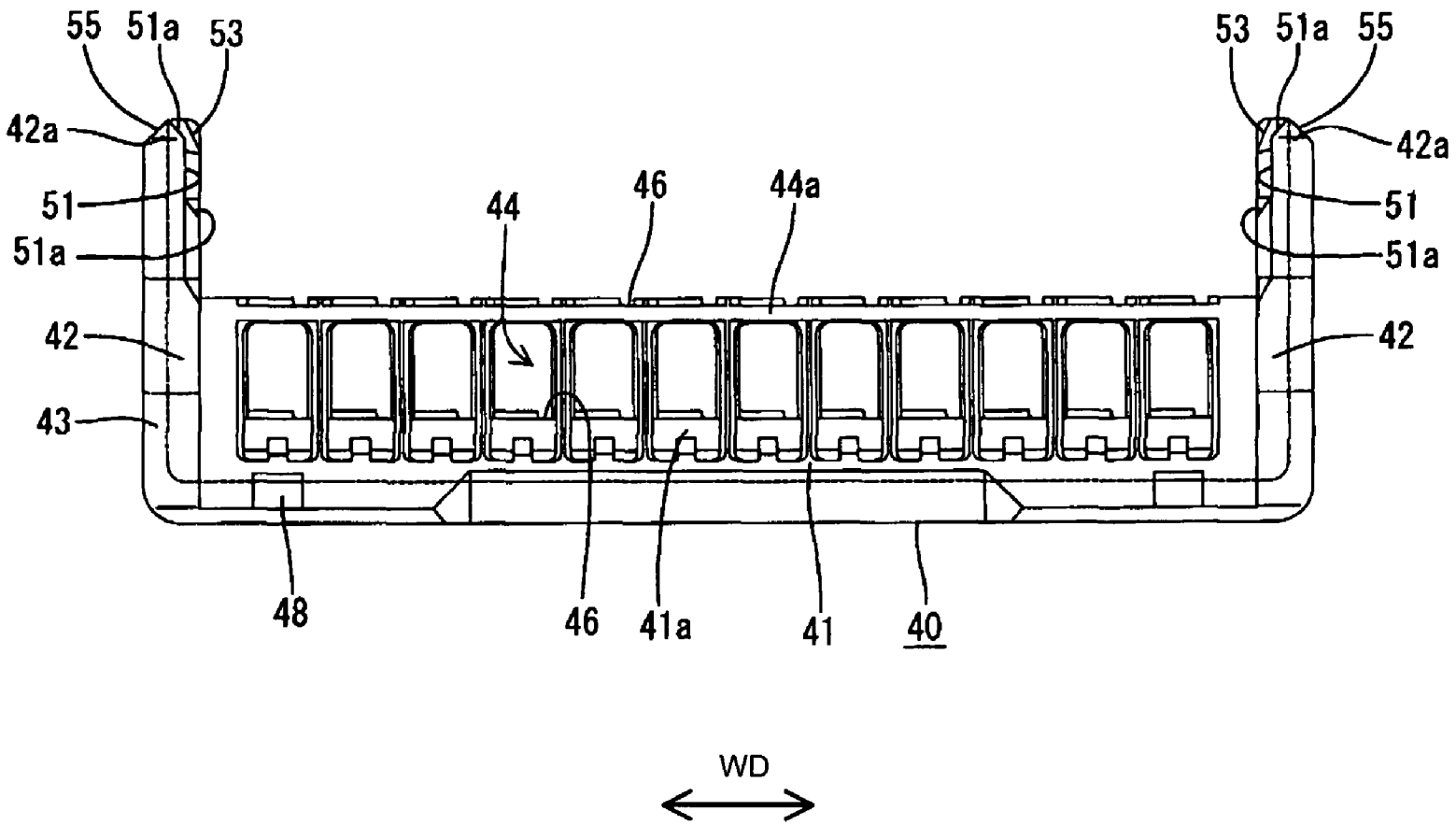
FIG. 5 is a rear view of the retainer.

The retainer 40 is formed e.g. of a synthetic resin similar to the male housing 20 and is comprised of a retainer main body 41 to be fit in the retainer mount hole 27 in the mounting direction MD as shown in FIG. 4. Side plates 42 are coupled to the opposite widthwise ends of the retainer main body 41 and are mounted to substantially cover the stepped surfaces 29 from outer sides. The retainer 40 is movable in the mounting direction MD oblique to the inserting and withdrawing directions IWD of the male terminal fittings 10 between a partial locking position (FIGS. 7 to 10) and a full locking position (FIGS. 11 to 13). Operable portions 43 bulge out sideways and down at the rear portion of the retainer 40, including both side plates 42. The operable portions 43 are used to operate the retainer 40.

The retainer main body 41 is formed with the same number of windows 44 as the cavities 23 at each stage of the male housing 20. The windows 44 penetrate the retainer main body 41 in forward and backward directions and are formed to aligned with the cavities 23 at the lower stage. The front opening edges of the respective windows 44 extend substantially straight along the vertical direction, and hence substantially conform to the front edge of the retainer mount hole 27. The rear opening edges of windo0ws 44 are sloped to conform to the rear edge of the retainer mount hole 27. Front upper portions 44*a* of the respective windows 44 and a lower portion 41 a of the retainer main body 41 define locking sections 45 that substantially align with the bottom walls 23*a* of the cavities 23 and are retracted from the cavities 23 when the retainer 40 is at the partial locking position, thereby permitting the insertion and withdrawal of the male terminal fittings 10 (see FIG. 7). However, the locking sections 45 enter the cavities 23 and engage the locking steps 16 and the protrusions 17 when the retainer 40 is at the full locking position (see FIG. 11). Each locking section 45 has a stabilizer-passing groove 46 that can communicate with the stabilizer insertion groove 26 of the corresponding cavity 23 when the retainer 40 is at the partial locking position. Escaping recesses 47 are formed behind or adjacent each locking section 45 for letting projecting parts of the male terminal fitting 10, the wire W, etc. escape. Substantially triangular locks 48 project up at opposite widthwise ends of the rear surface of the retainer 40 for engaging the corresponding locking recesses 34 when the retainer 40 reaches the full locking position.

The side plates 42 of the retainer 40 have inner surfaces coupled to opposite widthwise ends of the retainer main body 41 over substantially the entire length, but project up substantially normal from the retainer main body 41. Thus, the side plates 42 are supported only at one end and upper ends 42*a* of the side plates 42 are free to deform resiliently away from the stepped surfaces 29 substantially along widthwise direction WD. Base ends of the side plates 42 are coupled to and extend along the upper edge and the inclined rear edge of the retainer main body 41. The two side plates 42 are spaced to hold the stepped surfaces 29 of the terminal-accommodating portion 22 of the male housing 20 from opposite outer sides. The side plates 42 also at least partly close the side openings of the retainer mount hole 27 when the retainer 40 is at the full locking position, and have a size to face a specified range (excluding the rear end portion) of the stepped surface 29. The side plates 42 have a thickness substantially equal to a level difference between the stepped surfaces and the outer side surfaces of the terminal-accommodating portion 22. Thus, the side plates 42 are substantially flush with the thick portions 28 when the retainer 40 is at the full locking position. Therefore, the side plates 42 of the retainer 40 define outer sidewalls of the male housing 20.

A long narrow guiding groove 49 penetrates each side plate 42 at a position behind the retainer main body 41, as shown in FIG. 4. The guiding groove 49 is aligned along the mounting direction MD, and hence has the same inclination as: the rear edges of the windows 44 of the retainer 40; the rear edge of the retainer mount hole 27; and the locking projection 30. The front and rear ends of the guiding groove 49 conform to the shapes of the front and rear ends of the locking projection 30. The guiding groove 49 simultaneously engages the locking projection 30 and the push-in preventing projection 31 to hold the retainer 40 at the partial locking position (see FIG. 8). However, forces on the retainer 40 in the mounting direction MD urge portions of the side plates 42 right after the rear ends of the guiding grooves 49 into the corresponding push-in preventing projections 31. Thus, the side plates 42 deform resiliently away from the stepped surfaces 29 and the corresponding push-in preventing projections 31 exit the guiding grooves 49. Accordingly, the retainer 40 can move in the mounting direction MD from the partial locking position to the full locking position. The projecting distance of the locking projections 30 is sufficiently larger than the push-in preventing portions 31 so that the locking projections 30 engage the guiding grooves 49 even when the side plates 42 are deformed away from the stepped surfaces 29. The retainer 40 reaches the full locking position (see FIG. 12) as the locking projections 30 approach the bottom ends of the guiding grooves 49. Engagement of the rear ends of the locking projections 30 with the rear ends of the guiding grooves 49 prevents the retainer 40 at the full locking position from making loose forward movements either along the moving direction MD or along the forward and backward directions of the male housing 10. Bores 50 penetrate the side plates 42 below the guiding grooves 49. The bores 50 have substantially the same inclination as the guiding grooves 49, but are narrower than the guiding grooves 49. The bores 50 reduce the rigidity of the side plates 42 and make the side plates 42 easier to deform away from the stepped surfaces 29.

A preventing recess 51 is formed in the inner surface of each side plate 42 above the guiding groove 49 for receiving the corresponding shake preventing portion 32. Slanted surfaces 51*a* are formed at the upper and bottom ends of the preventing recess 51. The preventing recess 51 extends from a substantially middle portion of the side plate 42 to the rear end thereof with respect to lengthwise direction and has an open rear end. The preventing recess 51 also has an open upper end and a bottom edge that substantially conforms to the shape of the upper edge of the guiding groove 49. Specifically, a front part of this bottom edge is substantially horizontal and parallel to the insertion and withdrawing direction IWD, whereas a rear part of the bottom edge is sloped down to the back an angle to the insertion and withdrawing direction IWD. The upper edges of the shake preventing portions 32 are held substantially at the same height as the upper edges of the preventing recesses 51 when the retainer 40 is at the partial locking position, thereby defining clearances to the bottom edges of the preventing recesses 51 (see FIG. 9). However, the slanted surfaces 32*a* at the bottom edges of the shake preventing portions 32 and the slanted surfaces 51*a* at the bottom edges of the preventing recesses 51 substantially abut when the retainer 40 is at the full locking position to prevent the retainer 40 from making upward or inwardly directed shaking movements (see FIG. 13).

An enlarged recess 52 extends forward from the preventing recess 51 and a locking claw 53 is formed at an upper end of the enlarged recess 52. The locking claws 53 are substantially at the upper ends 42*a* of both side plates 42, and face the holding portions 33 of the male housing 22 at substantially the same height when the retainer 40 is at the partial locking position (see FIG. 8). However, the locking claws 53 move over the slanted surfaces 33*a* of the holding portions 33 and engage the upper edges of the holding portions 33 to hold the retainer 40 at the full locking position (see FIG. 12) when the retainer 40 is moved to the full locking position. The holding portions 33 escape into the enlarged recesses 52 at the full locking position.

A clearance 54 is defined between the front edge of the retainer 40 and the front edge of the retainer mount hole 27 when the retainer 40 is at the partial locking position. The inserted states of the male terminal fittings 10 can be confirmed through the clearance 54 from outside the male housing 20.

The thick portions 28 of the male housing 20 are near the upper ends 42*a* and the front ends of the side plates 42 when the retainer 40 is at the full locking position. As shown in FIGS. 12 and 13, protecting portions 35 extend substantially along forward and backward directions at upper parts 28*a* of the thick portions 28 and face the upper ends 42*a* of the side plates 42. The protecting portions 35 cover at least parts of the upper ends 42*a* of the side plates 42 from the outer sides. The protecting portions 35 hang down at an angle from the upper parts 28*a* of the thick portions 28 to a position where the protecting portions 35 overlap the upper ends 42*a* of the side plates 42 with respect to the height direction when the retainer 40 is at the full locking position. Additionally, the protecting portions 35 extend forward and backward over substantially the entire length of the upper portions 28*a*. Accordingly, the protecting portions 35 cover the upper ends 42*a* of the side plates 42 from the outer sides. Each protecting portion 35 has a width that is about half the width of the upper portion 28*a* of the thick portion 28 and projects gradually more down toward the outside of the upper portion 28*a*. Accordingly, an inward-facing escaping surface 36 is defined on a side of the protecting portion 35 facing the upper end 42*a* of the side plate 42. The escaping surface 36 slopes down toward the outer side and lets the side plate 42 escape. The projecting end of each protecting portion 35 is rounded.

Escaping surfaces 55 are formed on the operable portions 43 by partially thickening the upper ends 42*a* of the side plates 42. The escaping surfaces 55 are inclined in substantially the same direction as the escaping surfaces 36 of the protecting portions 35 and face the protecting portions 35. The escaping surfaces 36, 55 on the protecting portions 35 and the side plates 42 help prevent interference between the side plates 42 and the protecting portions 35. Thus, the side plates 42 move smoothly towards and away from the stepped surfaces 29 due to the resilient deformation of the side plates 42 that occurs as the retainer 40 is moved between the partial and full locking positions. The escaping surfaces 36 of the protecting portions 35 have a more moderate inclination than the escaping surfaces 55 of the side plates 42. Thus, clearances between the escaping surfaces 36 and 55 become larger toward the outer side. Accordingly, the upper ends 42*a*, which are displaced most during the resilient deformation of the side plates 42 away from the stepped surfaces 29, escape more easily. Further, the protecting portions 35 are substantially flush with the side plates 42 although the outer ends thereof projects slightly outward from the side plates 42 (operable portions 43).

As shown in FIG. 7, the male terminal fitting 10 is inserted into each cavity 23 from behind, with the retainer 40 mounted at the partial locking position with respect to the male housing 20. The locking projection 15 and the protrusion 17 then are successively inserted into the protrusion insertion groove 25 and the stabilizer 18 is inserted into the stabilizer insertion groove 26 and the stabilizer-passing groove 46 for smoothly guiding the insertion of the male terminal fitting 10. The locking projection 15 presses and resiliently deforms the lock 24 outward when the male terminal fitting 10 is inserted to a specified depth. The locking projection 15 moves beyond the lock 24 when the male terminal fitting 10 reaches a proper depth, and the lock 24 then is restored resiliently and enters the recess 14 to engage the front edge of the recess 14 and the rear end surface of the locking projection 15.

The retainer 40 is moved from the partial locking position to the full locking position after all of the male terminal fittings 10 are inserted. More particularly, the retainer 40 is pushed in the mounting direction MD obliquely up to the front. Thus, portions of the side plates 42 around the bottom ends of the guiding grooves 49 are resiliently deformed to move over the push-in preventing projections 31. As a result, the push-in preventing projections 31 exit the guiding grooves 49 and the retainer 40 is pushed obliquely up in the mounting direction MD due to a guiding action achieved by the engagement of the locking projections 30 and the guiding grooves 49. The locking sections 45 enter the corresponding cavities 23 when the retainer 40 reaches the full locking position. Thus, the locking sections 45 engage the rear end surfaces of the locking steps 16 and the protrusions 17 of the corresponding male terminal fittings 10, as shown in FIG. 11, to lock the male terminal fittings 10 doubly.

The push-in preventing projections 31 exit the guiding grooves 49 in the process of moving the retainer 40 to the full locking position, and both side plates 42 resiliently deform away from the stepped surfaces 29 as the locking claws 53 move onto the holding portions 33. Thereafter, the retainer 40 reaches the full locking position, and the push-in preventing projections 31 are located at the rear side of the side plates 42. The locking claws 53 then move over the holding portions 33 to engage the upper edges of the holding portions 33 and escape into the enlarged recesses 52 as shown in FIG. 12. As a result, the side plates 42 are restored resiliently. The escaping surfaces 35, 55 shown in FIG. 13 enable the upper ends 42*a* of the side plates 42 to escape from the protecting portions 35 while the side plates 42 are being resiliently restored. Thus, the upper ends 42*a* of the side plates 42 can slip smoothly into the inner sides of the protecting portions 35.

External matter is unlikely to strike against or catch the upper ends 42*a* of the side plates 42 of the retainer 40 at this full locking position because the upper ends 42*a* are at least partly covered by the protecting portions 35 from the outer sides. This prevents the side plates 42 including the locking claws 53 from being deformed away from the stepped surfaces 29 by the external matter. Therefore, an undesirable event where the retainer 40 is inadvertently displaced toward the partial locking position can be prevented. The engagement of the locking claws 53 and the holding portions 33 at the full locking position is supplemented by engagement of the locking projections 30 with the bottom ends of the guiding grooves 49, the engagement of the push-in preventing projections 31 with the rear edges of the side plates 42, and the engagement of the lock portions 48 with the front surfaces of the locking recesses 34, as shown in FIG. 12. Thus, the retainer 40 is held firmly at the full locking position. Further, the retainer 40 is prevented from making upward shaking movements by the engagement of the bottom edges of the shake preventing portions 32 with the bottom edges of the preventing recesses 51. The front edge of the retainer main body 41 contacts the front edge of the retainer mount hole 27 in the full locking position while leaving almost no clearance. This prevents dust or the like from entering the cavities 23. After the assembling of the male connector is completed as above, the unillustrated mating female connector is fit into the receptacle 21.

The male terminal fittings 10 can be detached for maintenance or other reason by moving the retainer 40 from the full locking position to the partial locking position. This is achieved by inserting a jig in clearances between the side plates 42 and the stepped surfaces 29 from behind, for example, at positions between the upper portions 28*a* of the thick portions 28 and the shake preventing portions 32 in the state shown in FIGS. 12 and 13. Thus, both side plates 42 are deformed resiliently away from the stepped surfaces 29. At this time, the upper ends 42*a* of the side plates 42 can escape from the protecting portions 35 due to the escaping surfaces 36, 55. More particularly, the side plates 42 can be deformed smoothly away from the stepped surfaces 29 while the upper ends 42*a* slip under the protecting portions 35 to the outer sides. Thus, the locking claws 53 disengage from the upper edges of the holding portions 33 to move onto the outer surfaces of the holding portions 33. Additionally, the push-in preventing projections 31 disengage from the rear edges of the side plates 42 to slip into the inner sides of the side plates 42, and the lock portions 48 disengage from the locking recesses 34 to exit therefrom backward. As a result, the retainer 40 is freed from its held state at the full locking position. The retainer 40 then is moved obliquely down to the back in a direction opposite to the mounting direction MD, and the retainer 40 is moved towards the partial locking position shown in FIG. 10, thereby disengaging the locking sections 45 from the male terminal fittings 10. Thereafter, the lock 24 can be deformed down in the unlocking direction using a jig or the like, and the wire W can be pulled backward while the lock 24 is freed from its locked state.

As described above, the side plates 42 are exposed to the outside, but the upper ends 42*a* thereof are at least partly covered by the protecting portions 35 from the outer sides with the retainer 40 mounted at the full locking position. Thus, external matter is less likely to interfere with the upper ends 42*a* of the side plates 42. In this way, external matter is not likely to disengage the locking claws 53 from the holding portions 33. Therefore, the retainer 40 can be held at the full locking position with respect to the male housing 20, and the male terminal fittings 10 can be prevented from coming out with high reliability.

Further, the escaping surfaces 36, 55 on the facing surfaces of the side plates 42 and the protecting portions 35 enable the side plates 42 to escape during deformation away from the stepped surfaces 29 or resilient restoration thereafter. Thus, the retainer 40 can be moved smoothly.

Furthermore, the male connector can have a small size since the side plates 42 and the protecting portions 35 provided with the escaping surfaces 36, 55 are substantially flush with each other at their outer end positions.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the protecting portions cover the upper ends of the side plates in the foregoing embodiment, they may cover the front ends and/or the rear ends of the side plates.

Both the protecting portions and the side plates have escaping surfaces in the foregoing embodiment. However, only one of the protecting portions and the side portions may have the escaping surfaces.

The shapes of the locking claws and holding portions in the foregoing embodiment can be changed. Further, the locking claws and the holding portions can be omitted and the retainer can be held at the full locking position by the locking projections and the push-in preventing projections. In such a case, the escaping surfaces also may be omitted since the side plates deform away from the stepped surfaces around the push-in preventing projections.

The retainer is moved obliquely to the inserting and withdrawing directions of the male terminal fittings in the foregoing embodiment. However, the invention is also applicable to connectors where a retainer is moved normal to the inserting and withdrawing directions of terminal fittings.

The above-described connector has cavities arranged at upper and lower stages. However, the invention is also applicable to connectors with cavities at one, three or more stages. The terminal fittings may be mounted into a housing and thereafter the retainer can be mounted at a proper mount position with respect to the housing to lock the terminal fittings. In other words, the partial locking position of the retainer may be omitted.

Although the male connector is shown above, the invention is also applicable to female connectors with female terminal fittings.

The above-described retainer doubly locks the terminal fitting by engaging a locking step thereof. However, the terminal fittings may be locked doubly by a retainer that engages the lock to hinder the lock from disengaging from the terminal fitting when the retainer is at the full lock position.

The retainer in the above embodiment doubly locks the terminal fittings in the housing in cooperation with the locks. However, the retainer may be the only means for locking the terminal fittings.

What is claimed is:

1. A connector comprising a housing with opposite front and rear ends and at least one cavity extending between the ends for receiving at least one terminal fitting inserted into the cavity along an inserting direction, a retainer mount hole extending transversely into the housing and communicating with the cavity and a retainer mountable to the housing at the retainer mount hole for locking the terminal fitting in the cavity of the housing, wherein:

the retainer comprises a main body with at least one locking section for at least partly entering the retainer mount hole along a mounting direction angularly aligned to the inserting direction and for directly locking the terminal fitting when the retainer is mounted at a proper mount position with respect to the housing, and side plates at opposite lateral ends of the main body for at least partly covering outer surfaces of the housing, the side plates having tapered peripheral ends, and the housing comprises protecting portions spaced outwardly from the outer surfaces of the housing and disposed so that the tapered peripheral ends of the side plates are between the outer surfaces of the housing and the protecting portions when the retainer is mounted at the proper mount position and so that portions of the side plates between the peripheral ends and the main body are exposed.

2. The connector of claim 1, wherein holding means for holding the retainer at the proper mount position are provided on the side plates and the outer surfaces of the housing.

3. The connector of claim 2, wherein the holding means comprise holding portions on the outer surfaces of the housing and locks on inner surfaces of the side plates, the locks being engageable with the holding portions.

4. The connector of claim 3, wherein the side plates are resiliently deformable away from the outer surfaces of the housing as the locks move onto the holding portions during mounting and detaching the retainer.

5. The connector of claim 1, wherein a clearance is defined between the retainer and a portion of the housing when the retainer is at a position different from the proper mount position, so that an inserted state of the male terminal fitting can be confirmed through this clearance from outside the housing.

6. The connector of claim 1, wherein at least one weakened portion is provided in the side plates for making the side plates easier to deform away from outer surfaces of the housing.

7. The connector of claim 1, wherein locking means are provided for holding the retainer at a position on or in the housing different from the proper mount position.

8. The connector of claim 1, wherein guiding means are provided on the side plates and the outer surfaces of the housing for guiding movement of the retainer with respect to the housing.

9. A connector comprising:

a housing for receiving at least one terminal fitting, the housing having outer surfaces and holding portions formed on the outer surfaces;

a retainer mountable to the housing at a proper mount position, the retainer having a main body with at least one locking section for locking the terminal fitting when the retainer is at the proper mount position, the retainer further having side plates at opposite lateral ends of the main body for at least partly covering the outer surfaces of the housing, locks formed on the side plates and configured for engaging the holding portions on the outer surfaces of the housing when the retainer is moved to the proper mount position, the side plates being resiliently deformable away from the outer surfaces of the housing as the locks move relative to the holding portions during mounting and detaching the retainer; and protecting portions projecting from the housing and disposed outwardly from the outer surfaces of the housing so that peripheral ends of the side plates are between the outer surfaces of the housing and the protecting portions, wherein escaping surfaces are provided on at least one of facing surfaces of the protecting portions and the side plates for letting the side plates resiliently deform away from the corresponding outer surfaces of the housing.

10. The connector of claim 9, wherein the escaping surfaces are provided on both the facing surfaces of the protecting portions and the side plates, and the protecting portions are formed to be substantially flush with outer ends of the side plates.

11. The connector of claim 10, wherein the escaping surfaces of the protecting portions and the escaping surfaces of the side plates each are inclined with respect to a mounting direction of the retainer onto the housing, and wherein the escaping surfaces of the protecting portions have a more moderate inclination than the escaping surfaces of the side plates.

* * * * *